US008998392B2

(12) United States Patent
Kobayashi et al.

(10) Patent No.: US 8,998,392 B2
(45) **Date of Patent: *Apr. 7, 2015**

(54) LIQUID SUPPLYING AND COLLECTING APPARATUS

(71) Applicant: Seiko Epson Corporation, Tokyo (JP)

(72) Inventors: Atsushi Kobayashi, Nagano-ken (JP); Shinya Yamagata, Nagano-ken (JP); Kiyoshi Mukaiyama, Nagano-ken (JP); Steven Chen, Taipei (TW); Juliet Chen, Taipei (TW)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/941,993

(22) Filed: Jul. 15, 2013

(65) Prior Publication Data

US 2013/0300808 A1 Nov. 14, 2013

Related U.S. Application Data

(60) Division of application No. 13/485,382, filed on May 31, 2012, now Pat. No. 8,485,652, which is a continuation of application No. 13/040,041, filed on Mar. 3, 2011, now Pat. No. 8,201,932, which is a division of application No. 11/410,789, filed on Apr. 24, 2006, now Pat. No. 7,922,307.

(30) Foreign Application Priority Data

Apr. 28, 2005 (JP) ..... 2005-133446

(51) Int. Cl.
*B41J 2/175* (2006.01)
*B41J 2/165* (2006.01)

(52) U.S. Cl.
CPC ..... *B41J 2/175* (2013.01); *B41J 2/17509* (2013.01)

(58) Field of Classification Search
USPC ..... 347/31, 36, 85, 90
See application file for complete search history.

(56) References Cited

U.S. PATENT DOCUMENTS

| | | | | |
|---|---|---|---|---|
| 4,383,263 | A | 5/1983 | Ozawa et al. | |
| 4,432,005 | A | 2/1984 | Duffield et al. | |
| 4,695,824 | A * | 9/1987 | Tazaki | 347/86 |
| 4,965,596 | A | 10/1990 | Nagoshi et al. | |
| 5,172,140 | A * | 12/1992 | Hirabayashi et al. | 347/36 |
| 5,894,313 | A | 4/1999 | Mabuchi | |
| 5,963,237 | A | 10/1999 | Ikkatai et al. | |
| 5,975,677 | A | 11/1999 | Marler et al. | |
| 6,082,851 | A | 7/2000 | Shihoh et al. | |

(Continued)

FOREIGN PATENT DOCUMENTS

| | | |
|---|---|---|
| CN | 1576021 A | 2/2005 |
| EP | 0911170 A2 | 4/1999 |

(Continued)

*Primary Examiner* — Anh T. N. Vo
(74) *Attorney, Agent, or Firm* — Stroock & Stroock & Lavan LLP

(57) ABSTRACT

An ink supplying and collecting apparatus includes a case, ink cartridges detachably attached to the case, and a collecting container detachably attached to the case. The ink cartridges supply ink to a recording head of a printer via ink supply tubes. The collecting container collects ink drained from the recording head via an ink drain tube. The case is located outside of and is separate from the printer. Thus, the sizes and shapes of the ink cartridges and the collecting container can be freely designed.

9 Claims, 3 Drawing Sheets

(56) References Cited

U.S. PATENT DOCUMENTS

| | | | | |
|---|---|---|---|---|
| 6,199,976 | B1 | 3/2001 | Sasada | |
| 6,227,642 | B1 | 5/2001 | Hanabusa et al. | |
| 6,281,911 | B1 | 8/2001 | Nakazawa et al. | |
| 6,352,324 | B1 | 3/2002 | Pagnon et al. | |
| 6,361,142 | B1 | 3/2002 | Otsuka et al. | |
| 6,578,948 | B2 | 6/2003 | Shima | |
| 6,805,436 | B2 | 10/2004 | Ujita et al. | |
| 6,905,189 | B1 | 6/2005 | Duffield | |
| 6,908,182 | B2 | 6/2005 | Nakazawa et al. | |
| 6,929,341 | B2 | 8/2005 | Mizoguchi et al. | |
| 6,976,746 | B2 | 12/2005 | Shimamura | |
| 7,008,051 | B2 | 3/2006 | Akermalm | |
| 7,018,029 | B2 | 3/2006 | Ishizawa et al. | |
| 7,101,027 | B2 | 9/2006 | Iijima et al. | |
| 7,163,284 | B2 | 1/2007 | Su et al. | |
| 7,198,342 | B2 | 4/2007 | Mizoguchi | |
| 7,201,475 | B2 | 4/2007 | Shiho et al. | |
| 7,273,271 | B2 | 9/2007 | Shiho et al. | |
| 7,367,662 | B2 | 5/2008 | Kimura et al. | |
| 7,370,949 | B2 | 5/2008 | Shiho et al. | |
| 7,399,070 | B2 | 7/2008 | Nakamura et al. | |
| 7,413,296 | B2 | 8/2008 | Shiho et al. | |
| 7,922,307 | B2 | 4/2011 | Kobayashi et al. | |
| 8,201,932 | B2 | 6/2012 | Kobayashi et al. | |
| 8,485,652 | B2 * | 7/2013 | Kobayashi et al. | 347/85 |
| 2003/0218660 | A1 | 11/2003 | Matsumoto et al. | |
| 2004/0012648 | A1 | 1/2004 | Mizoguchi et al. | |
| 2005/0057622 | A1 | 3/2005 | Kimura et al. | |
| 2007/0158475 | A1 | 7/2007 | Kimura et al. | |
| 2008/0036831 | A1 | 2/2008 | Kimura et al. | |

FOREIGN PATENT DOCUMENTS

| | | | |
|---|---|---|---|
| EP | 1498272 | A1 | 1/2005 |
| JP | 60-198256 | A | 10/1985 |
| JP | 02-038798 | A | 2/1990 |
| JP | 07-060991 | A | 3/1995 |
| JP | 07-246712 | A | 9/1995 |
| JP | 09-310964 | A | 12/1997 |
| JP | 11-348299 | A | 12/1999 |
| JP | 2000-006435 | A | 1/2000 |
| JP | 2000-141705 | A | 5/2000 |
| JP | 2000-153619 | A | 6/2000 |
| JP | 2000-203051 | A | 7/2000 |
| JP | 2000-301737 | A | 10/2000 |
| JP | 2002-001993 | A | 1/2002 |
| JP | 2003-231276 | A | 8/2003 |
| JP | 2003-320680 | A | 11/2003 |
| JP | 2003-326732 | A | 11/2003 |
| JP | 2003-341029 | A | 12/2003 |
| JP | 2004-237495 | A | 8/2004 |
| JP | 2005-041159 | A | 2/2005 |
| JP | 2005-047058 | A | 2/2005 |
| TW | 517015 | B | 1/2003 |
| WO | 97/42035 | A1 | 11/1997 |
| WO | 2004/073987 | A1 | 9/2004 |

* cited by examiner

LIQUID SUPPLYING AND COLLECTING APPARATUS

CROSS-REFERENCE TO RELATED APPLICATIONS

This application is a divisional application of U.S. patent application Ser. No. 13/485,382, filed on May 31, 2012, which is a continuation application of U.S. patent application Ser. No. 13/040,041, filed on Mar. 3, 2011, now U.S. Pat. No. 8,201,932, which itself is a divisional of U.S. patent application Ser. No. 11/410,789 filed on Apr. 24, 2006, now U.S. Pat. No. 7,922,307, which is based upon and claims the benefit of priority from prior Japanese Patent Application No. 2005-133446, filed on Apr. 28, 2005, the entire contents of which are incorporated herein by reference.

BACKGROUND OF THE INVENTION

The present invention relates to a liquid supplying and collecting apparatus for a liquid ejection apparatus such as an inkjet printer, more particularly to a liquid supplying and collecting apparatus that supplies liquid to a liquid ejection apparatus and recovers liquid drained from the liquid ejection apparatus.

As a liquid ejection apparatus that ejects liquid from a liquid ejection head to a target, an inkjet recording apparatus (hereinafter, simply referred to as a printer), for example, is known. Such a printer includes in it an ink supply tank (liquid supplying member) for supplying ink to a liquid ejection head and an ink collecting tank (liquid collecting member) for recovering waste ink drained from the liquid ejection head. As such a printer, a type has been known that has an ink supply tank and an ink collecting tank both mounted on a carriage (for example, Japanese Laid-Open Patent Publication No. 7-60991). In a printer disclosed in Japanese Laid-Open Patent Publication No. 7-60991, when performing a restoration operation (cleaning) of a liquid ejection head, ink in ejection nozzles provided in the liquid ejection head is drawn by a pump with a cap being caused to closely contact the liquid ejection head. The drawn waste ink is collected and sent to an ink collecting tank.

The printer disclosed in Japanese Laid-Open Patent Publication No. 7-60991 has the ink supply tank and the ink collecting tank mounted on the carriage, it is difficult to increase the sizes of the tanks. When performing a large amount of printing, cleaning and flushing of the liquid ejection head are performed an increased number of times. Therefore, when the printer is often used for a large amount of printing, an ink supply tank and ink collecting tank of small sizes require frequent replacement.

Further, Japanese Laid-Open Patent Publication No. 7-60991 discloses a type of printer in which an ink supply tank and an ink collecting tank are located at positions other than a carriage (see FIG. 6 of the publication). However, even in this case, since the ink supply tank and the ink collecting tank are still located inside the printer, the tanks need to be located in a dead space where various types of parts forming the printer are not provided. Thus, the sizes and shapes of these tanks cannot be freely designed. Particularly, in a case where an ink absorbing member is located in the ink collecting tank, the shape of the ink absorbing member affects the amount of ink that can be retained by the ink collecting tank. However, when providing an ink collecting tank in a dead space described above, the shape of the ink absorbing member is limited by the shape of the dead space. That is, the ink absorbing member cannot be formed to have an ideal shape (for example, cubical or rectangular parallelepiped shape).

SUMMARY

Accordingly, it is an objective of the present invention to provide a liquid supplying and collecting apparatus that permits sizes and shapes of a liquid supplying member and a liquid collecting member to be freely determined.

To achieve the foregoing objectives, one aspect of the present invention provides a liquid supplying and collecting apparatus for a liquid ejection apparatus having a liquid ejection head. The liquid supplying and collecting apparatus includes a unit main body, a liquid supplying member, and a liquid collecting member. The liquid supplying member is provided in the unit main body. The liquid supplying member retains liquid and supplies the liquid to the liquid ejection head via a liquid supply tube. The liquid collecting member is provided in the unit main body, and collects liquid drained from the liquid ejection head via a liquid drain tube. The unit main body is located outside of and is separate from the liquid ejection apparatus.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

One embodiment according to the present invention will now be described with reference to FIGS. 1 to 6. Unless otherwise specified, a front-rear direction, an up-down direction, and a left-right direction are defined with a front side defined as a side towards the viewer (out of the page) in FIG. 1.

Figure 1:
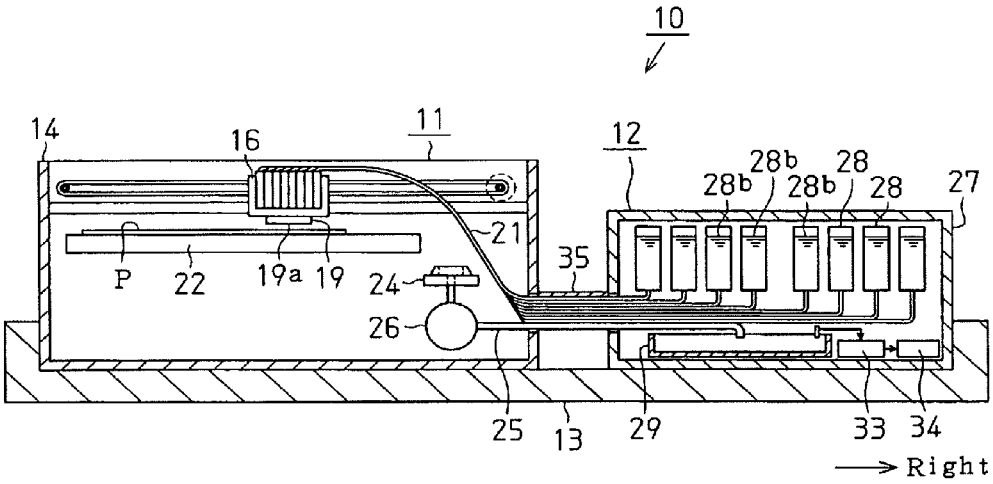
FIG. 1 is a cross-sectional view illustrating a liquid ejection system according to one embodiment of the present invention.

As shown in FIG. 1, a liquid ejection system 10 includes an inkjet printer (hereinafter, simply referred to as a printer) 11 functioning as a liquid ejection apparatus and an ink supplying and collecting apparatus 12 functioning as a liquid supplying and collecting apparatus. The ink supplying and collecting apparatus 12 supplies ink (liquid) to the printer 11 and recovers ink from the printer 11. The printer 11 and the ink supplying and collecting apparatus 12 are arranged side by side on a flat tray 13, which functions as a maintaining member or a support. Being located on the tray 13, the printer 11 and the ink supplying and collecting apparatus 12 are maintained at constant relative positions.

Figure 2:
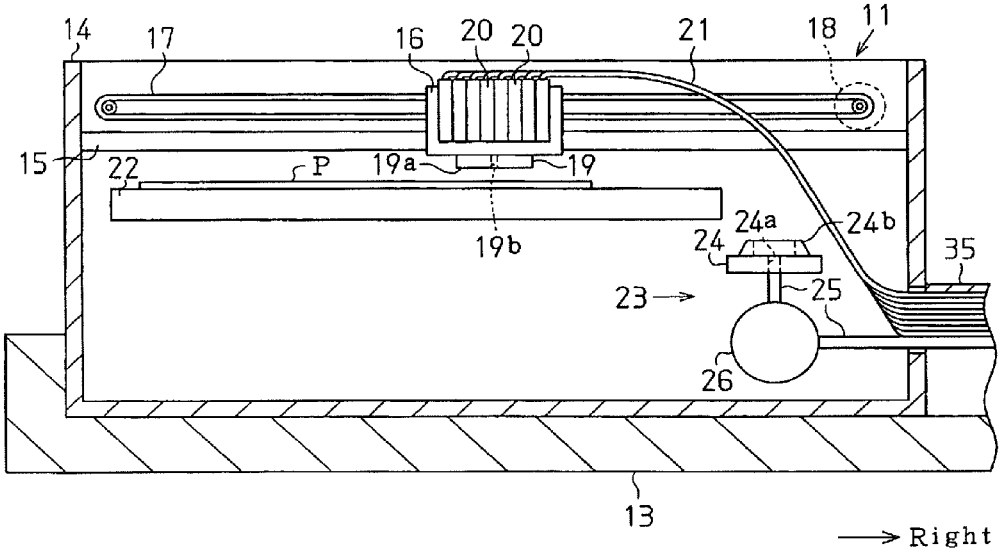
FIG. 2 is a cross-sectional view illustrating an inkjet printer in the liquid ejection system shown in FIG. 1.

As shown in FIG. 2, the printer 11 includes a substantially rectangular box-like case 14 that has a bottom wall and opens upward. A rod-like guide member 15 extends between left and right side walls of the case 14. A carriage 16 is supported by the guide member 15, which is passed through the carriage 16, so that the carriage 16 reciprocates leftward and rightward with respect to the guide member 15. The carriage 16 is coupled to a carriage motor 18 with a timing belt 17. The carriage motor 18 moves the carriage 16 along the guide member 15.

A recording head 19, which functions as a liquid ejection head, is mounted in a lower portion of the carriage 16. The lower surface of the recording head 19 is a nozzle surface 19*a*, in which nozzles 19*b* (only one is shown) are formed. Piezoelectric elements (not shown) are located on the recording head 19. Each piezoelectric element corresponds to one of the nozzles 19*b*. The carriage 16 has ink reservoir chambers 20, the number of which is eight in this embodiment, located above the recording head 19. Flexible ink supply tubes 21, the number of which is eight, extend from the ink supplying and collecting apparatus 12. The ink supply tubes 21 function as liquid supply tubes and are each connected to one of the ink reservoir chambers 20. Inks of a plurality of colors are each supplied to one of the ink reservoir chambers 20 from the ink supplying and collecting apparatus 12 through the associated ink supply tube 21. Each reservoir chamber 20 temporarily retains the supplied ink. In this embodiment, the eight ink reservoir chambers 20 receive inks of different colors, that is, inks of eight colors. Each ink, which is temporarily retained in one of the ink reservoir chambers 20, is supplied to the recording head 19.

A platen 22 extending leftward and rightward is provided below the carriage 16. The platen 22 is a support for supporting a target, which is a sheet of recording paper P. A paper handling mechanism (not shown) is located above the platen 22. During printing, the paper handling mechanism drives a paper handling motor (not shown) provided in the case 14, thereby feeding the sheet of recording paper P forward. While the carriage 16 is reciprocated along the guide member 15, when the piezoelectric elements are activated based on print data, the nozzles 19*b* on the nozzle surface 19*a* eject ink onto the sheet of recording paper P. Printing is thus performed onto the sheet of recording paper P.

A non-printing area (home position) is provided in a right end in the case 14. A cleaning mechanism 23 is provided in the non-printing area. The cleaning mechanism 23 has a cap 24, a flexible ink drain tube 25, which functions as a liquid drain tube, and a suction pump 26.

The cap 24 is substantially shaped as rectangular box that opens upward, and reciprocated upward and downward by a lift, motor (not shown) provided in the non-printing area. A vertical through hole 24*a* is formed the bottom wall of the cap 24. A substantially rectangular frame portion 24*b* made of a flexible material is located on the bottom wall of the cap 24. When the cap 24 is moved upward with the recording head 19 in the non-printing area, the frame portion 24*b* contacts and seals the nozzle surface 19*a*. Accordingly, a cap internal space, which is a sealed space, is defined. The openings of the nozzles 19*b* are exposed in the cap internal space.

The ink drain tube 25 is connected to the bottom wall of the cap 24 to communicate the suction hole 24*a*. The ink drain tube 25 extends to the ink supplying and collecting apparatus 12, and the suction pump 26 is located in the ink drain tube 25. When performing cleaning of the recording head 19, the suction pump 26 is activated with the cap 24 sealing the nozzle surface 19*a*. This draws ink of an increased viscosity in the recording head 19 from the nozzles 19*b* into the cap internal space. The ink is then discharged to the ink supplying and collecting apparatus 12 through the ink drain tube 25.

Figure 3:
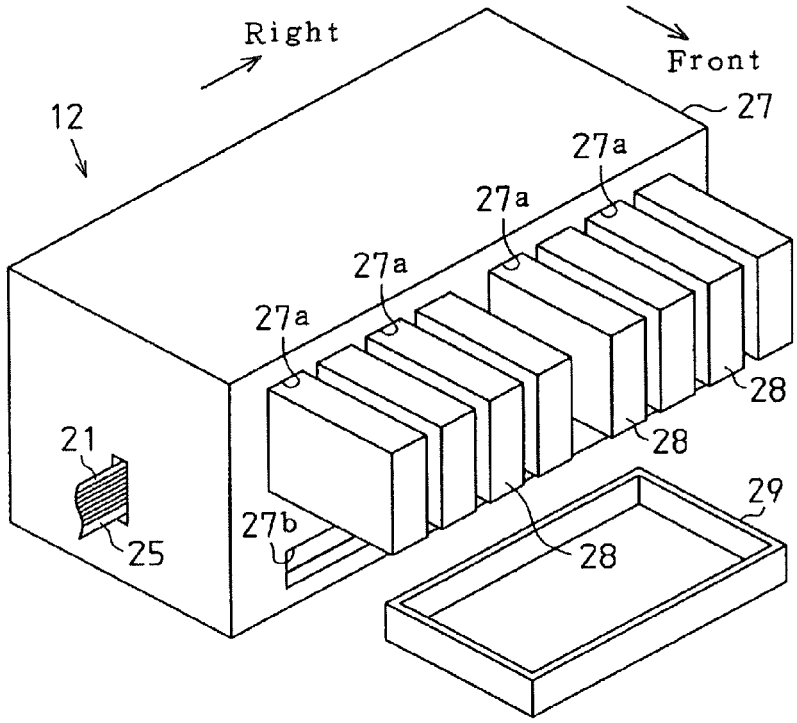
FIG. 3 is a perspective view illustrating an ink supplying and collecting apparatus in the liquid ejection system shown in FIG. 1.

As shown in FIG. 3, the ink supplying and collecting apparatus 12 includes a rectangular parallelepiped case 27, which functions as a unit main body. The ink supplying and collecting apparatus 12 includes ink cartridges 28, the number of which is eight in this embodiment, and a collecting container 29. The ink cartridges 28 function as liquid supplying members (or liquid retaining members), and the collecting container 29 functions as a liquid collecting member. Each ink cartridge 28 is rectangular parallelepiped and detachably attached to the case 27. The collecting container 29 is rectangular parallelepiped and detachably attached to the case 27. The ink cartridges 28 contain inks of different colors. The ink supplying and collecting apparatus 12 according to this embodiment is formed as a unit constructed by accommodating the ink cartridges 28 and the collecting container 29 in the case 27.

Eight first insertion openings 27*a* are formed in an upper portion of the front side of the case 27. The first insertion openings 27*a* are linearly arranged along the left-right direction. Each first insertion opening 27*a* receives one of the ink cartridges 28. A second insertion opening 27*b* is formed in a lower portion of the front side of the case 27. The second insertion opening 27*b* receives the collecting container 29.

Figure 4:
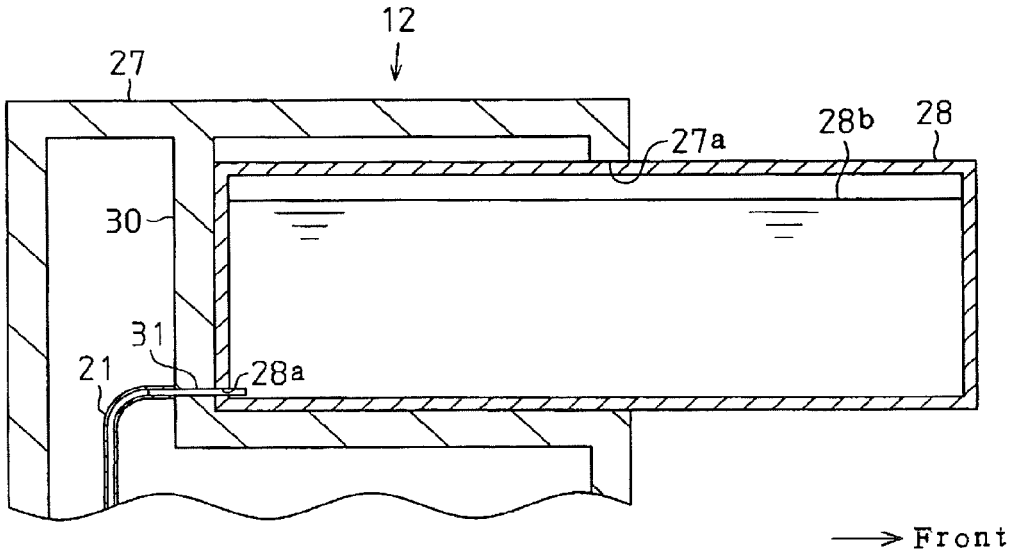
FIG. 4 is an enlarged partial cross-sectional view of the ink supplying and collecting apparatus shown in FIG. 3.

As shown in FIG. 4, a contact wall 30 is provided in the case 27. The contact wall 30 receives the ink cartridges 28 inserted into the case 27. Each ink cartridge 28 can be inserted into the case 27 through the corresponding first insertion opening 27*a* until it contacts the contact wall 30. Eight cylindrical supply needles 31 (only one is shown) are provided in the lower end of the contact wall 30. Each supply needle 31 corresponds to one of the ink cartridges 28. The supply needles 31 extend in a front-rear direction through the contact wall 30.

A supply hole 28*a* is formed in a lower portion of the rear wall of each ink cartridge 28. When the rear end of each ink cartridge 28 contacts the contact wall 30, the front end of the corresponding supply needles 31 is inserted into the supply hole 28*a* and reaches the interior of the ink cartridge 28. A valve mechanism (not shown) is provided in each supply hole 28*a*. In a state where the supply needle 31 is not inserted into the supply hole 28*a*, the valve mechanism closes the supply hole 28*a* so that ink in the ink cartridge 28 does not leak from the ink supply hole 28*a*.

An end of one of the ink supply tubes 21 extending from the ink reservoir chambers 20 is connected to the rear end of each supply needle 31. Ink passages from the supply needles 31 to the recording head 19 are sealed from the atmosphere. When ink is consumed at the recording head 19, capillary force is generated in the nozzles 19*b*, which are minute holes. The capillary force causes ink in the ink cartridges 28 to be supplied to the recording head 19 through the ink supply tubes 21 and the ink reservoir chambers 20.

As shown in FIG. 1, each ink cartridge 28 is arranged such that the fluid level 28*b* of the retained ink is lower than the nozzle surface 19*a* of the recording head 19, so that the pressure of the ink is not a positive pressure at the nozzle surface 19*a*. In other words, the position (height) of each ink cartridge 28 relative to the recording head 19 is set such that a negative pressure acts on ink in the nozzle 19*b*. That is to say, each ink cartridge 28 retains ink such that the ink receives a negative pressure in the nozzle 19*b*. The height of each cartridge 28 relative to the nozzle surface 19*a* is set such that ink in the ink cartridge 28 is properly supplied to the recording head 19 by capillary force generated in the recording head 19. As shown in FIG. 1, the printer 11 and the ink supplying and collecting apparatus 12 are arranged on the tray 13 so that the positions are determined with respect to the heights. The relative heights between the printer 11 and the ink supplying and collecting apparatus 12 cannot be arbitrarily changed by the user.

Figure 5:
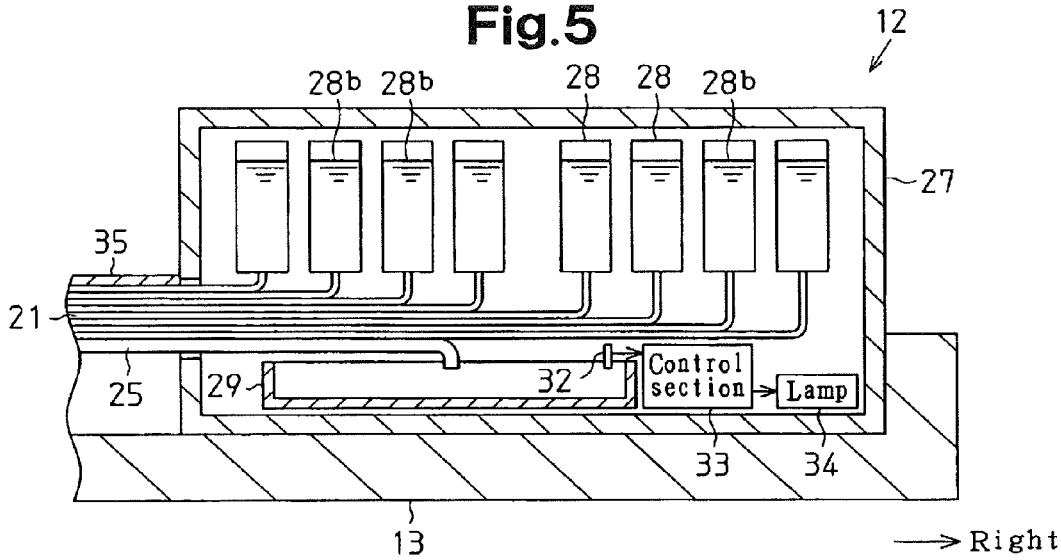
FIG. 5 is a schematic cross-sectional view showing the ink supplying and collecting apparatus shown in FIG. 3.

As shown in FIG. 5, in a state where the collecting container 29 is attached to the case 27 through the second insertion opening 27*b* (see FIG. 3), an end of the ink drain tube 25 extending from the cap 24 is located in the collecting container 29, and an ink sensor 32 supported in the case 27 is located in the collecting container 29.

The ink sensor 32 is electrically connected to a control section 33 located in the case 27. The control section 33 is electrically connected to a lamp 34, which functions as an alarm and is located on the surface of the case 27. When the amount of ink in the collecting container 29 reaches a predetermined level (80% to 90% of the volume of the collecting container 29), the ink sensor 32 contacts the ink. Accordingly, the ink sensor 32 sends a signal to the control section 33, and based on the signal, the control section 33 causes the lamp 34 to continuously emit light.

Figure 6:
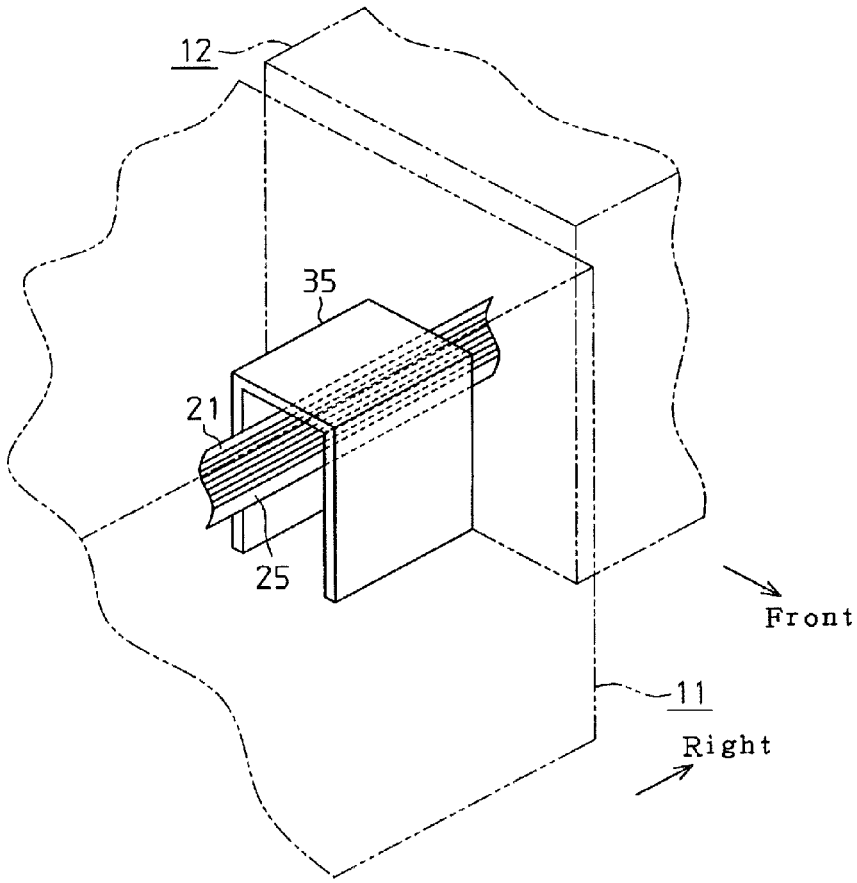
FIG. 6 is a perspective view illustrating a cover in the liquid ejection system shown in FIG. 1.

As shown in FIG. 6, a cover 35 is provided between the case 14 of the printer 11 and the case 27 of the ink supplying and collecting apparatus 12. The cover 35 covers sections of the ink supply tubes 21, the ink drain tube 25, and various cables (not shown) that extend between the cases 14 and 27. The cover 35 has a channel-like cross-section, and is made of a rigid material such as metal. The length of the cover 35 is substantially equal to the distance between the cases 14 and 27, and the lower end of the cover 35 is fixed to the tray 13 (see FIG. 1).

As ink in the ink reservoir chambers 20 is consumed during printing performed by the printer 11, the capillary force generated in each nozzle 19*b* of the recording head 19 causes ink the amount of which corresponds to the consumed ink to be supplied from the corresponding ink cartridge 28 to the recording head 19 through the corresponding ink supply tube 21 and the corresponding ink reservoir chamber 20. Also, during the cleaning of the recording head 19, the ink drained from the recording head 19 is collected and sent to the collecting container 29 via the cap internal space and the ink drain tube 25. When the lamp 34 lights up, the user removes the collecting container 29 from the second insertion opening 27*b* and discards the waste ink in the collecting container 29. Then, the user inserts the collecting container 29 into the case 27 from the second insertion opening 27*b*. This prevents the waste ink from overspilling from the collecting container 29.

The above described embodiment provides the following advantages.

(1) Since the case 27 of the ink supplying and collecting apparatus 12 is located outside of the printer 11 and separate from the printer 11, the sizes and the shapes of the ink cartridges 28 and the collecting container 29 can be freely determined. Thus, when performing a large amount of printing using the printer 11, it is unnecessary to frequently replace the ink cartridges 28 or to frequently discard the collected ink in the collecting container 29.

(2) Each ink cartridge 28 is provided in the ink supplying and collecting apparatus 12 to be located above the collecting container 29. Therefore, each ink cartridge 28 is easily located at a height for allowing capillary force to supply ink in each cartridge 28 to the recording head 19.

(3) Since the ink cartridges 28 and the collecting container 29 are detachably attached to the case 27 of the ink supplying and collecting apparatus 12, replacement of the ink cartridges 28 and discarding of collected ink in the collecting container 29 can be easily performed.

(4) Ink in each ink cartridge 28 is supplied to the recording head 19 by capillary force generated in the corresponding nozzle 19*b* of the recording head 19. Therefore, no pressurizing motor for pressurizing ink is required. That is, ink can be supplied to the ink reservoir chambers 20 and the recording head 19 without an electric power source. Therefore, the size of the ink supplying and collecting apparatus 12 (the case 27) and the running costs (electricity costs) of the apparatus 12 can be reduced.

(5) The fluid level 28*b* of the ink in each ink cartridge 28 is at a lower height than the nozzle surface 19*a* of the recording head 19. Therefore, no positive pressure is applied to the ink at the nozzle surface 19*a* of the recording head 19. Thus, the amount of ink ejected from the recording head 19 is prevented from being excessive. Also, the ink ejection is prevented from being unstable. That is, an appropriate amount of ink is ejected from the recording head 19 in a stable manner.

(6) Being arranged on the tray 13, the printer 11 and the ink supplying and collecting apparatus 12 (the case 27) are maintained at constant relative positions. Thus, the head of ink in each cartridge 28 is maintained properly. Therefore, using capillary force generated in the nozzles 19*b* of the recording head 19, ink is reliably supplied to the ink reservoir chambers 20 and the recording head 19.

(7) The cover 35 covers sections of the ink supply tubes 21, the ink drain tube 25, and various cables that extend between the case 14 of the printer 11 and the case 27 of the supplying and collecting apparatus 12. Therefore, the tubes 21, 25 and the cables are not exposed and reliably protected.

The above illustrated embodiment may be modified as follows.

The cover 35 may be omitted.

The tray 13 may be omitted.

Each ink cartridge 28 is configured such that ink in the cartridge 28 has a free liquid level. However, as liquid supplying members, for example, sealed bags may be used that retain ink under a pressure environment equivalent to the static head in the above described ink cartridges 28. In this case, the sealed bags are liquid supplying members that retain liquid such that liquid receives a negative pressure in each nozzle 19*b*.

The ink cartridges 28 may be arranged such that the fluid level 28*b* of ink in each ink cartridge 28 is equal to or higher than the height of the nozzle surface 19*a* of the recording head 19.

Ink in the ink cartridges 28 may be pressurized by a pressurizing pump and supplied to the recording head 19.

The collecting container 29 or the ink cartridges 28 may be undetachably attached to the case 27 of the ink supplying and collecting apparatus 12. Both of the collecting container 29 and the ink cartridges 28 may be undetachably attached to the case 27. In this case, the case 27 needs to be constructed so as to permit the ink cartridges 28 to be supplied with ink and waste ink in the collecting container 29 to be discarded.

The case 27 of the ink supplying and collecting apparatus 12 may be constructed such that the collecting container 29 is located above the ink cartridges 28.

The printer 11 and the ink supplying and collecting apparatus 12 may be constructed to be disconnectable from each other. In this case, each of the ink supply tubes 21 and the ink drain tube 25 is cut in a position between the printer 11 and the ink supplying and collecting apparatus 12, and the divided sections of each tube are connected to each other with a joint. This configuration allows, for example, the ink supplying and collecting apparatus 12 to be replaced by a type that supplies ink using a pressurizing pump as shown above.

An ink absorbing member may be located in the collecting container 29 to absorb and retain collected oil. In this case, the ink absorbing member is preferably a rectangular parallelepiped so that it can be accommodated in the collecting container 29. This permits collected oil to be efficiently retained.

As an alarm, a sound-generating device that generates buzz sound or melody may be used.

The number of the cartridges 28 provided in the case 27 of the ink supplying and collecting apparatus 12 may be other than eight.

In the illustrated embodiment, the present invention is applied to the inkjet printer 11 functioning as a liquid ejection apparatus. However, the present invention may be applied to liquid ejection apparatus such as an apparatus for manufacturing color filters for liquid crystal displays and an apparatus for forming pixels of organic electroluminescent displays.

Therefore, the present examples and embodiments are to be considered as illustrative and not restrictive and the invention is not to be limited to the details given herein, but may be modified within the scope and equivalence of the appended claims.

The invention claimed is:

1. A liquid supplying apparatus for supplying liquid to a liquid ejection apparatus having an outer case and a liquid ejection head located in the outer case, comprising:

a unit case which is separate from and located outside of the outer case of the liquid ejection apparatus;

a liquid retainer detachably attached into the unit case;

a liquid supply tube for supplying the liquid to the liquid ejection head; and a supply needle provided in the interior of the unit case, wherein the liquid supply tube is connected to the supply needle in the unit case, wherein the liquid retainer is connected to the supply needle in the unit case when inserted into the unit case, and wherein the liquid supply tube is covered between the unit case and the outer case of the liquid ejection apparatus.

2. An apparatus for use with a liquid ejection apparatus having an outer case and a liquid ejection head located in the outer case, the apparatus comprising:

a unit case which is separate from and located outside of the outer case; and a liquid collecting member provided in the unit case, the liquid collecting member collecting liquid drained from the liquid ejection head via a liquid drain tube, wherein the liquid collecting member is detachably attached to the unit case and is connected to the liquid drain tube in the unit case.

3. The apparatus according to claim 2, wherein an insertion opening, which receives the liquid collecting member, is formed in a lower portion of the front side of the unit case.

4. The apparatus according to claim 2, wherein the collecting member is rectangular parallelepiped and an upside of the collecting member is opened.

5. The apparatus according to claim 2, wherein a lamp is located on a surface of the unit case and functions as an alarm which the lamp emits light when an amount of the liquid in the collecting member reaches a predetermined level.

6. A liquid supplying apparatus for supplying liquid to a liquid ejection apparatus having an outer case and a liquid ejection head located in the outer case, comprising:

a unit case which is separate from and located outside of the outer case of the liquid ejection apparatus;

a plurality of liquid retainers detachably attached into the unit case;

a plurality of liquid supply tubes for supplying the liquid to the liquid ejection head; and a plurality of supply needles provided in the interior of the unit case, wherein each of the liquid supply tubes is connected to one of the supply needles in the unit case, the unit case includes a plurality of insertion openings for receiving the plurality of liquid retainers, respectively, each of the supply needles is located in a corresponding insertion opening from one of the plurality of insertion openings, and each of the liquid retainers is connected to one of the supply needles when received in the corresponding insertion opening.

7. The apparatus according to claim 6, wherein the unit case is located at a side of the outer case of the liquid ejection apparatus.

8. The apparatus according to claim 7, wherein the liquid supply tubes are covered at least in part with a cover provided between the unit case and the outer case of the liquid ejection apparatus.

9. The apparatus according to claim 7, wherein the liquid supply tubes are covered between the unit case and the outer case of the liquid ejection apparatus.

* * * * *